US005184664A

United States Patent [19]

Hayashi et al.

[11] Patent Number: 5,184,664

[45] Date of Patent: Feb. 9, 1993

[54] MOLD FOR LEAD CASTING

[75] Inventors: Yuji Hayashi; Masahiro Ito, both of Takatsuki; Hiroyoshi Yoshida; Hiroyoshi Shibata, both of Himeji, all of Japan

[73] Assignees: Yuasa Battery Co., Ltd., Osaka; Kobe Cast Iron Works, Ltd., Kobe, both of Japan

[21] Appl. No.: 723,076

[22] Filed: Jun. 28, 1991

[30] Foreign Application Priority Data

Jul. 2, 1990 [JP] Japan ..... 2-175670

[51] Int. Cl.[5] ..... B22D 25/04

[52] U.S. Cl. ..... 164/271; 164/138

[58] Field of Search ..... 164/138, 271; 249/60, 249/135

[56] References Cited

U.S. PATENT DOCUMENTS 3,789,910 2/1974 Matter et al. ..... 164/122

FOREIGN PATENT DOCUMENTS 0192464 8/1989 Japan ..... 249/60

*Primary Examiner*—Richard K. Seidel
*Assistant Examiner*—Erik R. Puknys
*Attorney, Agent, or Firm*—Armstrong, Westerman, Hattori, McLeland & Naughton

[57] ABSTRACT

A mold for lead casting comprising a porous metal material which does not form an alloy with molten lead and which has a thermal conductivity of from 3-15 kcal/(m·hr·°C.) and having a percentage of pores having a radius larger than or equal to 40 microns being 7% or less of the total pore volume. The porous metal material has a permeability of at least 0.2 ml/sec·cm$^2$ at a material thickness of 10 mm and ambient pressure of 0.02 kg/cm$^2$. A casting mold enabling casting of a lead grid without using a lubricant due to the lubricity of the mold material itself is realized.

1 Claim, 3 Drawing Sheets

MOLD FOR LEAD CASTING

BACKGROUND ART

1. Industrial Useful Field

This invention relates to an improvement in a mold for lead casting which is used in casting of grids or spines for lead battery and in casting of lead parts for lead battery.

2. Prior Art and its Problem

In casting the grids and spines for lead battery; mold for lead casting is used at present, which are provided with thermal insulation, air venting ability and mold releasing ability by coating a so-called "lubricant" composed mainly of cork powder on metal surfaces made of cast material through means of the spraying method.

However, since the lubricant is composed mainly of the cork powder, it is carbonized by thermal decomposition when contacting unceasingly with molten lead heated to 500° to 400° C. Further, its thickness is decreased by being pressed by a pressure of the molten lead due to an elasticity of the cork layer. The lubricant layer gradually loses its thermal insulation, so that solidification of molten lead will commence and so-called cross-grain will be produced before completion of flow of molten lead i.e. before a time required for the molten lead to spread into the entire cavity to be filled has elapsed, if the same conditions as the initial fresh lubricant are set as they are. When the thickness of the lubricant layer becomes small, a weight of grid will become scattered because a weight of grid of product will increase gradually.

When a worker judges that the lubricant has deteriorated as described above, the former coated layer should be removed by brushing and a new layer should be sprayed again. However, since it requires a long term of experience to learn the skill of coating the lubricant to its level of practical use, a worker employed in casting process must be a skilled person who has achieved complete mastery. Namely, the worker must acquire such techniques that a coating thickness is to be altered in consideration of the grid frame thickness, basin, air venting etc., and air venting grooves are to be formed in portions where air is hard to be vented. Accordingly, restrictions are placed in freely posting workers within a factory from the existing state of things. Further, it is difficult to invite skilled workers in a newly built factory.

A time until the lubricant is completely deteriorated or a number of casting shot can not be determined unconditionally because it depends on a mixing/prescribing method of cork powder, a kind of alloy, a thickness of grid, a sectional area of frame and mold cooling method etc. In case of antimony alloy, it is generally said that three or four hours will be required for that purpose. Therefore, two times of recoating per day are necessary. In case of calcium alloy, it is said that three times bf recoating per day are necessary. It requires 20 to 30 minutes for a skilled worker to perform this work, and the casting machine should be shut down during this period. The sum of shut-down time per day reaches 40 to 90 minutes on every casting machine.

This lubricant coating work generally consists of an air spraying method, in which the cork powder dissolved in water glass, glue or phosphoric acid base binder solution is sprayed onto a heated metal surface; so that the cork powder scatters around the machine to contaminate its periphery and the method does not provide a good work environment.

As described above, the lubricant has a function necessary for enabling the casting. However, if there exists some other method for enabling the casting without using the lubricant, it can not be doubted that the casting work can be carried out effectively in all respects.

SUMMARY OF THE INVENTION

An object of this invention is to provide a mold which allows casting of lead grid without using a lubricant by giving a lubrication function to mold material itself.

This invention provides a mold for lead casting comprising porous metal material which does not make an alloy with molten lead and has a thermal conductivity ranging from 3 kcal/(m·hr·° C.) to 15 kcal/(m·hr·° C.), having a pore diameter distribution wherein pores having a pore radius of 40 microns or more make up, and having a permeable rate of at least 0.2 ml/sec·cm$^2$ with material thickness of 10 mm and ambient pressure of 0.02 kg/cm$^2$.

In order to cast the grid, it is enough to develop mold material satisfying the following conditions:

[1]Industrial casting shall be possible. Namely, molten lead in the mold shall not be solidified until the molten lead spreads into the mold cavities, and the molten lead shall be solidified as quickly as possible, within several seconds from industrial point of view, after it has spread into the cavities.

[2]The grid shall have a surface property with an excellent mold releasability.

[3]Products shall satisfy demands for quality required (having overall dimensions and weight as designed, including no defects such as burr and cross-grain etc., and having corrosion resistance).

Giving consideration to the function of coated layer consisting of the cork powder, the layer is almost composed of air so that it forms a thermal insulation layer having a small thermal conductivity because the cork is porous. This means that the mold is provided with a heat retaining ability required for the molten lead to completely spread into the mold cavities. It can be though from the fact of continuous porosity that breathing cycles are repeated, wherein air is temporarily drawn in spaces inside layer when the molten lead flows down to compress air in cavities and then air is discharged to atmosphere when the mold is opened. Thus, the cross-grain etc. due to insufficient gas venting is not produced. Naturally, in the event when the gas venting is not sufficient, it is regular procedure to install a slit called as "air vent".

The lead after solidification will leave carbon surfaces because cork powder surfaces contact with the hot molten lead to be burnt and carbonized. It is well known that the carbon surface is excellent in lubrication property and mold releasability. This is the reason why the mold has a good releasability.

An object of the invention is to provide a maintenance-free mold which satisfies all the above-mentioned requirements, and which can produce a casting grid having a higher precision than conventional one by only adjusting the mold temperature according to an ordinary method A particularly skilled worker is not necessary for the work and the time required for spraying the lubricant can be utilized to the other production purpose, so that a productivity can be improved by about 15% to 20% as compared with prior one. Moreover, since the cavity volume does not change, a scattering of grid weight becomes small.

A decrease in scattering of grid thickness leads to a decrease in scattering of an amount of applied paste in the next pasting process, so that an effect of stabilizing quality can be expected.

It goes without saying that working loads such as mixing and spraying the lubricant, cleaning around machines etc. can be lessened by a large margin, and the work environment can be improved.

BRIEF DESCRIPTION OF THE DRAWINGS

FIG. 3(*b*) is a view showing a successive change of grid thickness.

DETAILED DESCRIPTION

Figure 1:
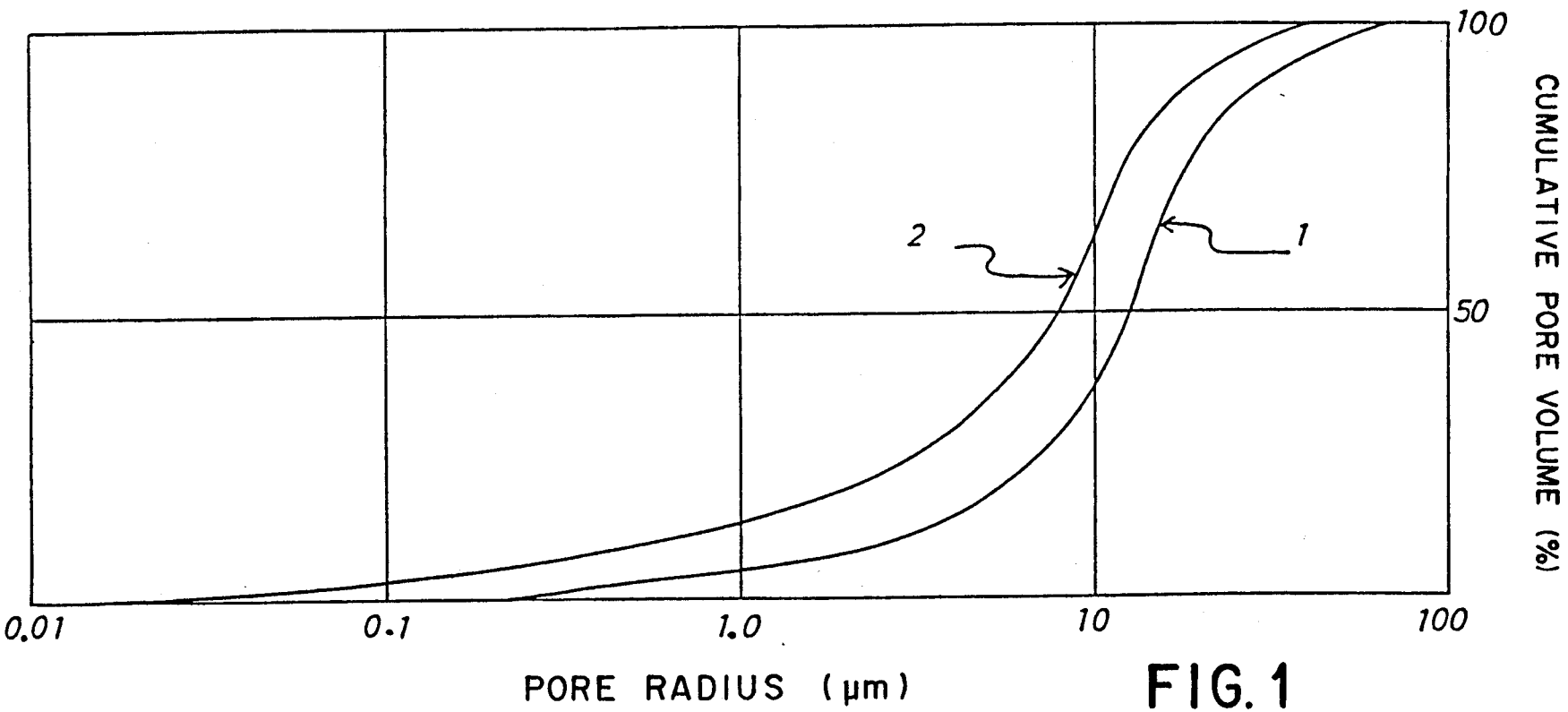
FIG. 1 is a view showing an example of pore diameter distribution of porous metal material.

Embodiment 1: Requirement for Heat Retaining Ability

In order to examine thermal characteristics of cast iron mold applied with cork layer used in prior art, a thermal conductivity of cork layer and a coefficient of heat transfer under applied state were measured.

Lubricant solution using water glass as its binder was mixed by the ordinary method, and spraying and drying operations were repeated to form a block made of cork powder having dimensions of 50×50×5 mm. Its thermal conductivity was measured by the thermal diffusion method and was proved to be 0.034 kcal/(m·hr·° C.) approximately same as that of air.

Then, the lubricant was sprayed onto a cast iron material until a thickness of 0.1 mm was attained and a coefficient of heat transfer between it and molten lead under fluidized state was measured and proved to be 150 to 310 kcal/($m^2$·hr·° C.).

It can be assumed that a heat transfer resistance exists mainly on the mold material side because the molten lead is under the fluidized state so that the molten lead side heat transfer resistance is so small as to be negligible. Therefore, in order to obtain thermal characteristics similar to the foregoing, it is enough to select a material having a thermal conductivity which will be equal to the measured coefficient of heat transfer.

As described in the next paragraph, the thermal conductivity will become smaller than that of solid material depending on a value of porosity because the mold material itself is made permeable in order for providing the air venting ability.

Embodiment 2: Requirement for Air Venting Ability

When the molten lead is poured, air existing in cavities should be expelled from the grid cavities until the solidification commences. The present invention is based on a fundamental idea that air passes from wall surfaces of the mold cavities to backsides of the mold by using the permeable material as the mold itself.

The permeable rate required for the mold material will be calculated hereunder. It is preferable that air having a volume corresponding to that of cavities is completely exhausted through the cavity wall surfaces within a time required for the molten lead to fill up the cavities.

A cavity volume and a surface area of a typical grid having a height of 150 mm, a width of 270 mm, and a frame thickness of 2.0 mm were calculated and proved to be 0.18 $cm^3$ and 3.9 $cm^2$ respectively.

A pressure given to air inside the cavities was obtained by calculation.

Mercury was flown into a model mold of transparent acrylic resin, recorded on videotape and analyzed, and then a time required for the molten lead to spread into the entire cavities (a minimum time necessary for solidification) was measured. A flow-in velocity of the molten load was thus obtained. Since kinematic viscosities of the mercury and molten lead are roughly equal, it can be assume that flow of the mercury will approximately represents flow of the molten lead.

A permeable rate necessary for a mold material thickness of 40 mm was measured and proved to be 0.05 ml/sec·$cm^2$ under an ambient pressure of 0.02 kg/$cm^2$. Namely, it can be said that the air can get out of the cavities until the solidification is completed if the permeable rate is larger than this value. When converted to a material thickness of 10 mm, this value corresponds to 0.2 ml/sec·$cm^2$.

Accordingly, concerning various shapes of the grid, it is desirable to develop the material on the basis of this value.

If the molten lead enters pores when porous engraved surfaces of the grid contact with the molten lead, the product will be caught in the mold to cause a failure to release from the mold after solidification. Further, when the pores are blocked by the molten lead, the permeability will provably be lessened. Namely, the pore diameter distribution of porous body should be that which prevents the molten lead from entering and can maintain the permeability.

A desired max. pore diameter (radius) calculated from the fundamental equation of mercury press-in method, which is one of principles of pore diameter distribution measuring method, was about 40 microns. Therefore a required pore diameter distribution is such that a percentage of pores having radii larger than or equal to 40 microns, if existing, should be so small as not to increase the resistance of permeability even when the pores were clogged with molten lead.

Embodiment 3: Manufacture and Evaluation of Material

Among metals selected from Embodiment 1, porous iron was manufactured first of all.

Molten iron was sprayed from fine holes under an atmosphere of inert gas to build up powder having average grain size of 30 microns. Primary molding product was formed by compressing the foregoing powder with a proper pressure, then it was sintered to obtain a porous body having a porosity of about 30% and a size of 100×100×10 mm. Mold material should have a prescribed mechanical strength from a stand point of machining and handling. A tensile strength of the above sample was measured and proved to have a value of about 65% of a solid iron material. An air passing velocity was measured and proved to be 0.39 ml/sec·$cm^2$ under an ambient pressure of 0.02 kg/$cm^2$. The average pore radius was 13 microns and a percentage of volume of pores having pore radius of above 40 microns was 7% of the entire pore volume. A thermal conductivity of the sample, which is naturally smaller than the solid iron because the sample is porous, was measured by the laser flash method and proved to be 14 kcal/(m·hr·° C.).

A fiber having a diameter of 50 microns and a length of 2.0 mm was built by the chattering method using cast iron as its raw material. This was sintered in the same way as the powder, a sample of the same size was built, and its characteristics were measured. The porosity was 25%, the thermal conductivity was 15 kcal/(m·hr·° C.), the average pore radius was 8 microns, and the air passing velocity under an ambient pressure of 0.02 kg/cm$^2$ was 0.21 ml/sec·cm$^2$. Pore diameter distributions of the foregoing porous iron and cast iron are shown in FIG. 1. In FIG. 1, 1 shows iron and 2 shows cast iron.

Incidentally, it is understood that the porosity and pore diameter distribution and air passing ability can be controlled within a certain range by the properties such as grain size of raw powder, fiber thickness and length etc., the pre-forming pressure and the sintering condition.

Porous bodies were built also by using SUS304, SUS316 and SUS430 which have low thermal conductivities, so-called umber alloy, Hastelloy C etc. in place of the iron and cast iron with powder or fiber used as raw materials in the same way. In this instance, the mold material was subjected to a condition that it did not make an alloy with the molten lead. The molten lead was put on plates of respective materials and proved not to adhere to them.

Characteristics of metal material for mold composed of the foregoing construction materials which can be judged as appropriate for the mold material, were listed in Table 1.

TABLE 1

| | | | Characteristics of metal material for mold | | | | | |
|---|---|---|---|---|---|---|---|---|
| No | Name of material | Composition | Raw material | Porosity (%) | Average pore radius (μm) | Thermal conductivity (kcal/m$^2$ · hr · °C.) | Permeable rate | Remark |
| 1 | Iron | Fe | Powder | 30 | 13 | 14 | 0.4 | — |
| 2 | Cast iron | Fe, C, Si, Mn | Fiber | 25 | 8 | 15 | 0.2 | — |
| 3 | SUS304 | Fe, Cr, Ni | Powder | 30 | 20 | 5 | 0.4 | — |
| 4 | SUS316 | Fe, Cr, Ni, Mo | Powder | 30 | 20 | 5 | 0.4 | — |
| 5 | SUS430 | Fe, Cr, C | Fiber | 35 | 15 | 8 | 0.4 | — |
| 6 | Amber | (Fe)36Ni | Fiber | 35 | 20 | 3 | 0.9 | — |

Embodiment 4: Practicability Possibility Test

By using porous cast iron utilizing the powder as its raw material among materials obtained by the same method as Embodiment 3, a plate having sizes of 400×350×35 mm was manufactured. It was previously confirmed that characteristics of this material were nearly equal to those of Embodiment 3.

Figure 2:
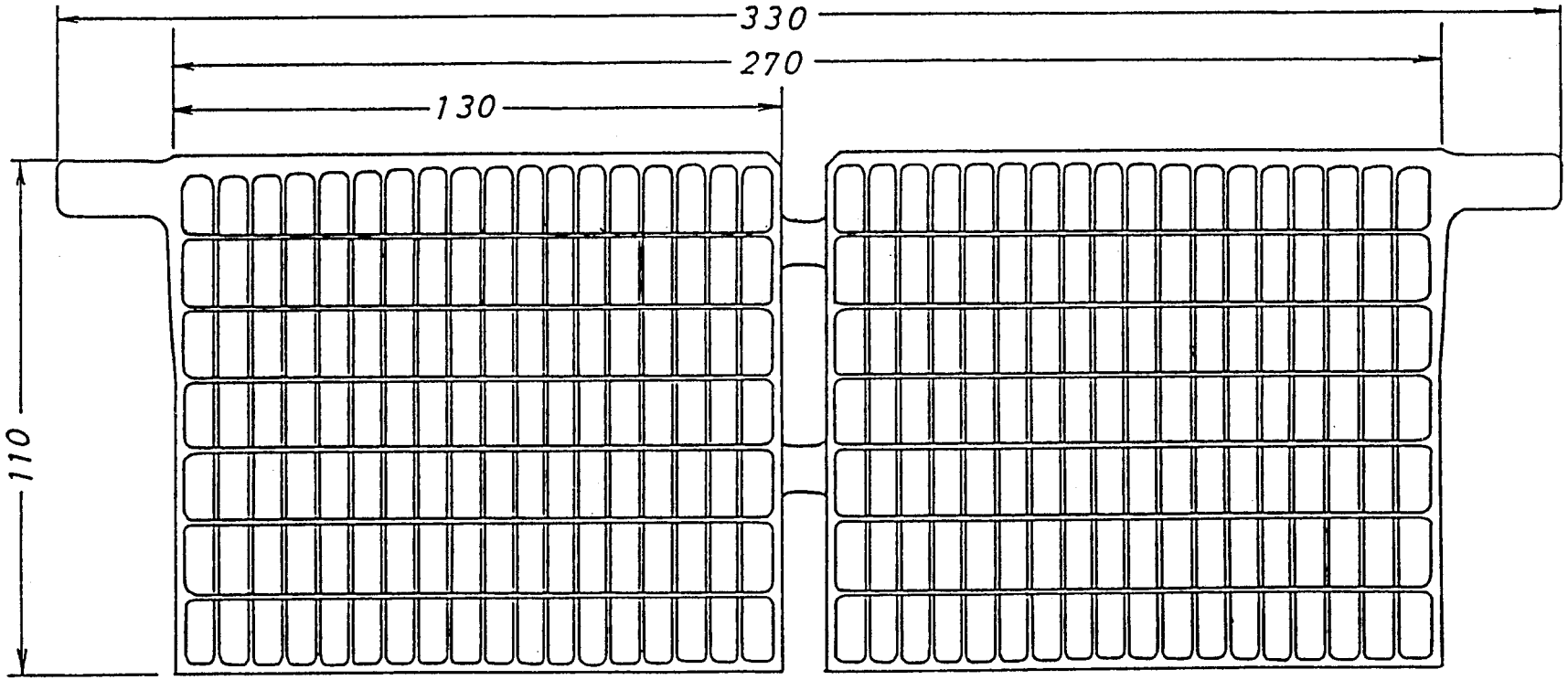
FIG. 2 is a plan view of grid.

Typical shapes on the grid were engraved by ordinary shaping or milling. The mold was of double-product type, and sizes of panel was such as thickness: 2.7 mm, height: 110 mm, width: 270 mm. Sectional area of main frame was 5.25 mm$^2$ and that of sub-frame was 1.5 mm$^2$. A design weight was 200 grams. A shape of product after cutting is shown in FIG. 2.

Since a flow quantity of molten metal at gate portion is large, a solidification velocity at that portion is naturally small. In case where the lubricant is not used, a thermal insulator layer having a property to an extent of using the lubricant is necessary in order to prevent heat from being taken away when the falling molten lead strikes against the gate portion, so that a coating layer composed mainly of carbon was applied. Further, in order to shorten a cooling time up to solidification, a thickness of the gate portion was decreased by about 25% as compared with the case of lubricant system mold.

Heaters were buried in the gate portion and grid portion by the ordinary method.

Copper tubes with inside diameter of 8 mm were buried in the gate portion and grid portion so as to obtain uniform temperature distribution of the mold, so that the mold could be cooled through means of liquid medium such as water, hot water or oil etc. ON/OFF valve system was employed for the control of cooling. A medium flow meter was also installed.

From the stand point of temperature adjustment, the mold was divided into two upper and lower sections, and these sections were so constructed that they can be heated and cooled. Namely, although the gate portion and the grid portion might thermally interfere each other to some extent, they were constructed so as to control their temperatures independently from other within a certain temperature range. A conducted pre-test proved that accuracies of temperature control of respective portions were ±5° C.

The mold thus manufactured was fitted to a conventional casting machine a mold opening portion of which was modified to a hydraulic type, and casting test was carried out. Lead alloy including 0.1% calcium and 0.7% tin was used. A molten lead temperature, a gate mold temperature and a mold temperature at grid engraved portion are roughly considered as parameters for temperature condition. Various experiments were carried out by combining these conditions, and it was found that a perfect product including no cross-grain, dent and burr could be produced under conditions of the molten lead temperature: 475° to 520° C., the gate mold temperature: 240° C. and the mold temperature at grid engraved portion: 240° C. A mold closing time after filling molten lead under these fundamental temperature conditions, i.e. a cooling time was 9.5 seconds.

If the temperature distribution is not uniform in the mold, the mold material will be curved due to a difference between thermal expansions to cause a burr. A clearance between molds caused by curving was filled up by changing a coating thickness of lubricant layer in prior arts, but the clearance became the burr as it was when the layer was not used.

Since the mold was opened and closed hydraulically in this test, it became possible to correct the curving of mold. The burr could be practically controlled at a pressure of 2.5 kg/cm$^2$ converted to mold bearing pressure under the foregoing standard temperature conditions. Many burrs were produced and conforming products could not be obtained with a pressure of 1.8 kg/cm$^2$.

Machined surfaces of this mold are copied as they are on the grid surfaces. In order not to clog pores on surface, engraving machining conditions such as a shape of mill tip, rotation speed, feed speed, cutting speed etc.

were appropriately combined; so that the machined surface presented a something matte appearance. However, the machined grid surfaces were smoother than those of products obtained by using the conventional lubricant.

Embodiment 5: Evaluation of Products

Figure 3A:
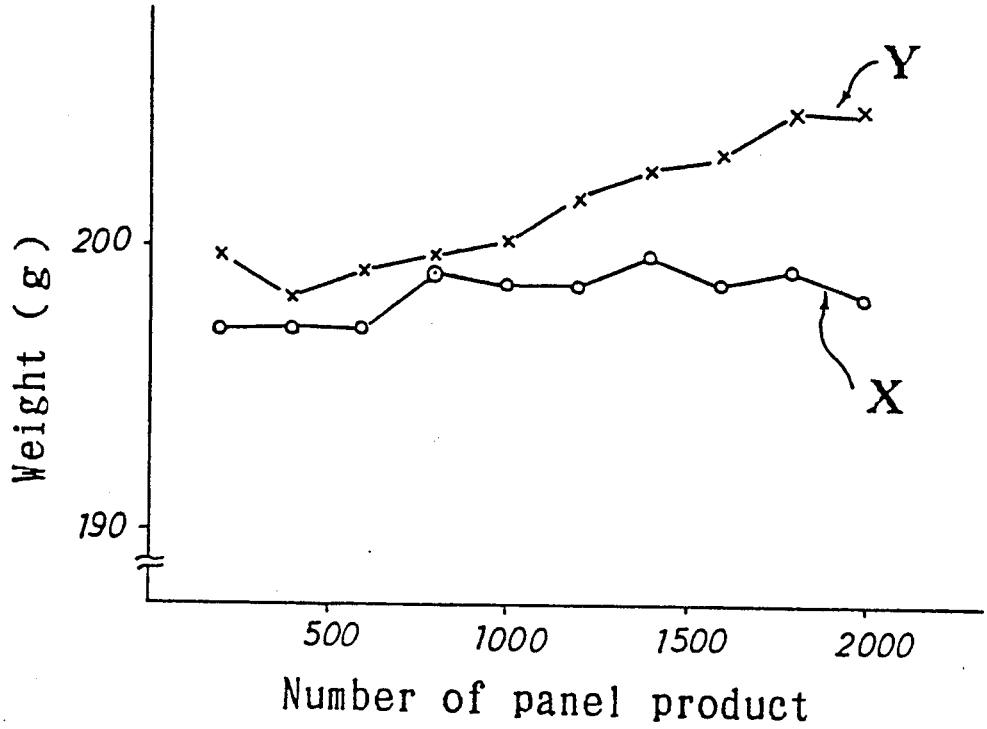
FIG. 3(*a*) is a view showing a successive change of grid weight.
Figure 3B:
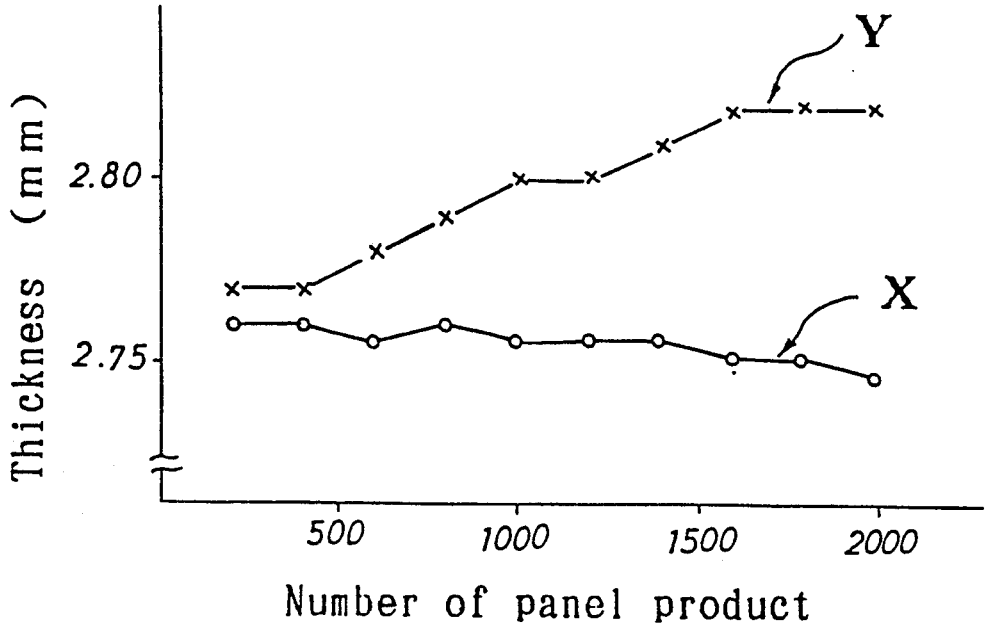

Continuous five panels were sampled from every 200 panels of the grid obtained by Embodiment 4, and successive changes of thickness and weight were examined and proved to be as shown by FIG. 3(*a*) and FIG. 3(*b*). In FIG. 3(*a*) and FIG. 3(*b*), X shows present invention system and Y shows conventional system. Successive changes of thickness and weight were not seen since the lubricant was not used. Scatterings of them were examined, and the following fact was found that the thickness was controlled to about a fourth and the weight was controlled to about a third as compared with the lubricant spraying system.

Since the solidification mode is different from that of the conventional lubrication spraying system, a difference ought to arise between crystal forms of the two. In order to ascertain an influence of the crystal form on performances of the grid, a difference was examined between ways by which grids obtained from the lubricant system and from Embodiment 4 were subjected to anodic oxidation.

Using five grids of Embodiment 4 and five grids of conventional lubricant spraying system for the anode and ordinary lead sheets for the cathode, an electric current of 5A was passed for 15 days in sulfuric acid having a specific weight of 1.28 under room temperature. The grids were pulled out of the solution and lead peroxide layers on surfaces were washed away. Then, weights of grids were measured and results were obtained as listed in Table 2. A difference of mean value was calibrated and no difference was found.

TABLE 2

Corrosion test results for grid
Conditions: $1.28H_2SO_4$, at room temperature, 5A(about 30 mA/dm$^2$), for 15 days

| No | Kind of grid | Weight of grid (g/piece) | Weight after 20 days (g/piece) | Peeling weight (g/piece) | Average of peeling weight (g/piece) | Percentage relative to total weight (%) |
|---|---|---|---|---|---|---|
| 1 | Without- | 198.2 | 188.3 | 9.9 | 7.5 | 3.8 |
| 2 | lubricant | 200.2 | 194.2 | 6.0 | | |
| 3 | system | 202.2 | 196.1 | 6.1 | | |
| 4 | | 190.3 | 182.7 | 7.6 | | |
| 5 | | 194.2 | 186.5 | 7.8 | | |
| 11 | Conventional | 202.7 | 193.6 | 9.1 | 8.3 | 4.1 |
| 12 | system | 204.7 | 196.5 | 8.2 | | |
| 13 | | 206.8 | 200.6 | 6.2 | | |
| 14 | | 196.6 | 186.8 | 9.8 | | |
| 15 | | 208.8 | 200.4 | 8.4 | | |

Five unformed plates were put in the pasting machine, applied with paste of active material and dried. Thus, a degree of adhesion between the paste and grid was examined. In order to compare easiness of falling of active material, the plates were fallen in parallel with and onto floor, and active material falling amounts were weighed. As shown by Table 3, there was no difference between the two.

TABLE 3

Adhesion test results between grid and active material

| No | Kind of grid | Weight of active material (dried state) | Peeling weight when fallen | Average of peeling weight (g/piece) | Percentage relative to total weight (%) |
|---|---|---|---|---|---|
| 1 | Con- | 231 | 4.3 | 6.7 | 2.8 |
| 2 | ventional | 237 | 5.6 | | |
| 3 | system | 223 | 7.2 | | |
| 4 | | 244 | 9.7 | | |
| 5 | | 246 | 6.5 | | |
| 11 | Without- | 234 | 3.7 | 7.1 | 3.0 |
| 12 | lubricant | 239 | 5.7 | | |
| 13 | system | 218 | 10.4 | | |
| 14 | | 246 | 7.8 | | |
| 15 | | 251 | 8.0 | | |

Embodiment 6: Practicability of Operation Time

As the cooling time was shortened under the temperature conditions of Embodiment 4, a region where lead at the gate did not solidify when opening the mold was reached after about 7 seconds, so that the molten lead became a state of overflowing. An operation was carried out with the mold temperature lowered, in order to quicken the solidification velocity.

When the mold gate temperature was set to 215° C., the operation could be carried out continuously with a cooling time of 7.5 seconds. By further lowering the temperature, dents and cross-grains arouse at 205° C. and it became impossible to obtain products having no defect.

In the next stage, the mold temperature at grid portion was lowered to shorten the cooling time. Thus, the cooling time could be shortened down to 7.0 seconds at a mold temperature at gate of 215° C. and that at grid of 220° C.

Further, a cooling time of down to 6.5 seconds was reached at a temperature at gate of 210° C. and that at grid of 210° C. In this connection, a cooling time of grid of the same design is 5.0 seconds in case of the lubricant spraying system.

Embodiment 7: Practicability Test 2

A porous body of practical size was manufactured by using SUS316, a mold was manufactured in the same way as Embodiment 4, and the casting test was carried out in the same manner.

A condition for obtaining conforming products was searched by changing the mold temperatures at gate and grid variously with the molten lead temperature kept same as Embodiment 4. Comparing with the case of cast iron, the gate temperature lowered by about 20° C. and the temperature of grid portion lowered by about 15° C. Namely, since the SUS316 material has a thermal conductivity smaller than that of the cast iron, its thermal radiation velocity from the lead to the mold is small. Consequently, since casting becomes possible even if the mold temperature is low and thermal distortion of the mold is small by that amount, burrs due to curving become hard to occur so that only a small mold pressing force is required.

A grid including no burr could be produced with a gate temperature of 180° C., a grid portion temperature of 175° C. and a mold tightening force of 0.9 kg/cm$^2$ converted to bearing pressure. A time required up to solidification was 6.5 seconds.

Embodiment 8: Practicability Test 3

A casting mold was manufactured by using the porous umber material in the same way as Embodiment 4, and the casting test was carried out in the same manner.

The umber material is one having the lowest thermal conductivity among general purpose metal materials. A casting mold composed of this material was manufactured and the casting test was carried out. A conforming grid could be obtained with a gate temperature of 165° C. and a grid portion temperature of 165° C.

The burr could be controlled with a mold tightening force of 0.8 kg/cm$^2$ converted to bearing pressure. A time required up to solidification was 7 seconds.

Embodiment 9: Practicability test 4

A casting mold was manufactured by using the solid cast iron material in the same way as Embodiment 3, and the casting test was carried out in the same manner by changing combinations of the gate temperature and mold temperature variously. The molten lead did not spread into the cavities and it was impossible to obtain products having no defect, even under any condition.

That is, the solidification arose too quickly and large defects were produced at lower portions of cavity when the mold temperature at grid was set to 260° C.

On the contrary, even when the temperature regulation was performed more accurately, it was very difficult to bring the cooling time into a practical range if the mold temperature was set to 285° C. Namely, this temperature required a cooling time of 27 seconds which was far from the practical time requirement. The cooling time was shortened to 21 seconds with the subject temperature of 280° C., however, cross-grains attributable to the failure of temperature regulation were found at a lower portion.

Slits for venting air were installed at grid section, but the cross-grain could not completely be removed.

Further, the solidification time will become long if the mold temperature is a little higher than the setting temperature, and the cross-grain will be produced if it is a little lower than the setting temperature. A limit of temperature regulation can be estimated to be ±3° C.

The following conclusions can be derived from these facts.

[1]When a material having a large thermal conductivity is used, it becomes very hard to control the mold temperature because the thermal radiation velocity from the molten lead is too large.

[2]When a solid material is used, it becomes extremely hard to completely vent air from the cavities.

As described in the Embodiments, it could be verified that the grid for lead battery could be cast without using the conventional lubricant.

This casting mold includes the following features.

[1]Engraved depths are not subjected to successive change due to deterioration of cork and engraved machined surfaces are copied as they are on the product grid , so that product size and weight can be obtained just as aimed.

Since the product weight becomes not subjected to the successive increase, the scattering in weight of grid can be eliminated.

Further, since the thickness is uniform, it becomes easy to adjust the machine for maintaining the thickness in the next pasting process so that the scattering of plate thickness after pasting can be minimized.

[2]Since the cork spray work becomes unnecessary, an operating time of the casting machine can be increased by about one hour per day in case of Ca alloy.

Assuming that the number of machine operable by one operator is normally increased from four to six and the operating time per day is increased from six hours to seven hours respectively, for example; the productivity will increase to 175% as compared with the conventional case, depending on a quantity of casting machine, a casting speed of machine, and a number of machine operable by one operator.

In case of Sb alloy, an increase in productivity of 150% which may be smaller than the case of Ca alloy, can be expected because a smaller spraying frequency of lubricant is required as compared with Ca alloy.

[3]since the cork powder is sprayed by air onto the heated mold surfaces in the lubricant spraying system, corks are scattered around the casting machine so that the environment around the machine is extremely soiled. In the casting mold of the present invention, however, the working environment can be improved by a large margin because no lubricant is used therefor.

[4]The skillfulness is required for the lubricant spraying work and it is difficult to train skilled workers under recent circumstances of lack of man power. According to the casting mold of the present invention, however, the lubricant spray work can eliminate the spraying work so that even an unskilled worker can produce conforming products without difficulty.

Materials for use in this invention are not limited to those described in the above Embodiments. There exists a wide variety of materials having a thermal conductivity, a permeability and a pore radius as defined by claims, so that a suitable material can be selected from among these materials in consideration of a material cost and a machining cost. It goes without saying that even ceramic material can be used provided that it is not cracked in handling.

The porosity can be suitably selected from a max. pore radius as defined in connection with the kind of material and manufacture of porous body, however, it upper limit is 50% from the stand point of strength of material.

The casting mold for grid of Ca alloy is described in the foregoing Embodiments, however, usable materials are not limited to them. It goes without saying that the present invention is also applicable to a casting mold for grid of Sb alloy, a casting mold for spine used in a tube-type plate, and a casting mold for casting small parts.

What is claimed is:

1. A mold for lead casting comprising a porous metal material which does not form an alloy with molten lead and has a thermal conductivity ranging from 3 kcal/(m·hr·°C.) to 15 kcal/(m·hr·°C.), and having a pore diameter distribution wherein pores having a pore radius of 40 microns or more make up 7% or less of the total pore volume, and having a permeable rate of 0.2 ml/sec·cm$^2$ or more at a material thickness of 10 mm and ambient pressure of 0.02 kg/cm$^2$.

* * * * *